US006019635A

United States Patent [19]

Nelson

[11] Patent Number: 6,019,635

[45] Date of Patent: Feb. 1, 2000

[54] COAXIAL CABLE CONNECTOR ASSEMBLY

[75] Inventor: James W. Nelson, Cheshire, Conn.

[73] Assignee: Radio Frequency Systems, Inc., Marlboro, N.J.

[21] Appl. No.: 09/030,153

[22] Filed: Feb. 25, 1998

[51] Int. Cl.[7] ..... H01R 9/05

[52] U.S. Cl. ..... 439/583; 439/610

[58] Field of Search ..... 439/578–585, 439/675, 610, 98

[56] References Cited

U.S. PATENT DOCUMENTS 4,046,451 9/1977 Juds et al. ..... 339/177 R
4,995,832 2/1991 Thommen et al. ..... 439/578
5,154,636 10/1992 Vaccaro et al. ..... 439/583
5,217,391 6/1993 Fisher, Jr. ..... 439/578
5,284,449 2/1994 Vaccaro ..... 439/583

*Primary Examiner*—Khiem Nguyen
*Attorney, Agent, or Firm*—Ware, Fressola, Van Der Sluys & Adolphson LLP

[57] ABSTRACT

A coaxial cable connector is disclosed. The connector includes a body, a backnut, a clamping insert and a deformable helical split washer. The deformable split washer, clamping insert, body and backnut provide a simple means for deforming and clamping the outer conductor. In one disclosed embodiment, the split washer is captivated in a tubular extension to facilitate installation on the outer conductor.

11 Claims, 5 Drawing Sheets

COAXIAL CABLE CONNECTOR ASSEMBLY

BACKGROUND OF THE INVENTION

1. Field of the Invention

The present invention relates generally to coaxial cable connectors. More particularly, the present invention relates to a connector assembly for coaxial cables having helically corrugated outer-conductors.

2. Description of the Prior Art

Coaxial cables are used to transmit radio frequency signals. Such cables have inner and outer conductors which are separated by a dielectric material. The outer conductors are sometimes made from a corrugated tube. The corrugations of the corrugated outer conductor may be annular or helical. The connector assembly of the present invention is directed to cables of the type having helical corrugated outer-conductors.

Connectors for radio frequency cables having helically corrugated outer conductors generally require a means to firmly grasp or secure the connector to the outer conductor of the cable. Van Dyke, U.S. Pat. No. 3,291,895, discloses a tab flare which is used to secure the connector to the outer conductor. Vaccaro et al, European Patent application No. 495467, Doles, U.S. Pat. No. 5,137,470 and Rauwolf, U.S. Pat. No. 5,167,533 disclose connector assemblies which include a flaring ring and a clamping member having opposed bevelled surfaces for engaging the respective inner and outer surfaces of the outer conductor of the cable. A body member draws and hold the bevelled surface of the flaring ring and the clamping member together against opposite surfaces of the outer conductor of the cable. One drawback of these assemblies is that they require extra steps to be taken to secure the connector to the outer conductor of the cable.

SUMMARY OF THE INVENTION

Accordingly, it is an object of the present invention to provide a connector for a cable having a helically corrugated outer conductor which can be easily installed without the use of any special tools and which provides a connection which cannot be easily loosened from the outer conductor.

It is also an object of the present invention to provide a connector for a cable having a helically corrugated outer conductor which can be easily manufactured.

In accordance with the present invention, the foregoing objectives are realized by the connector assembly of the present invention which comprises a connector for connecting a coaxial cable having an inner-conductor and a helically corrugated outer-conductor. The connector of the present invention comprises a cylindrical body having an interior, an internal threaded portion for engagement with a threaded backnut, and a shoulder portion for supporting a voltage standing wave ratio (VSWR) compensating clamping insert, the shoulder portion being disposed with its interior. The connector also includes an inner conductor contact having a dielectric spacer disposed thereover, the inner conductor contact is disposed within the interior of the cylindrical body and the dielectric spacer is dimensioned so as to provide a snug fit within the interior of the cylindrical body. A VSWR compensating cup shaped clamping insert having a body abutting end, a base with an opening which is dimensioned to allow the inner conductor to pass therethrough and an interior shoulder at the body abutting end for supporting a dielectric insert is provided. The clamping insert member is disposed within the cylindrical body so that the body abutting end is adjacent to the shoulder portion inside the body. According to the present invention, a dielectric insert having an opening with a diameter which is sufficient to allow an inner conductor to pass therethrough, is disposed within the clamping insert adjacent to its shoulder portion. A backnut, having a terminal end which resides within the body, has an interior threaded portion with threads corresponding to the helical corrugations of the outer conductor. The backnut also has an exterior threaded portion for cooperating with the internal threaded portion of the body, and a bearing surface at its internal terminal end. A deformable helical split washer having a pair of facing ends is threaded over the outer conductor. When the connector is assembled, the outer conductor and the split washer are deformed. The outer conductor is clamped between the split washer and the base of the clamping insert.

Other objects and advantages of the present invention will become apparent to those skilled in the art from the following detailed description read in conjunction with the attached drawings and claims appended hereto.

BRIEF DESCRIPTION OF THE DRAWINGS

The drawings, not drawn to scale, include.

DETAILED DESCRIPTION OF THE INVENTION

Figure 1:
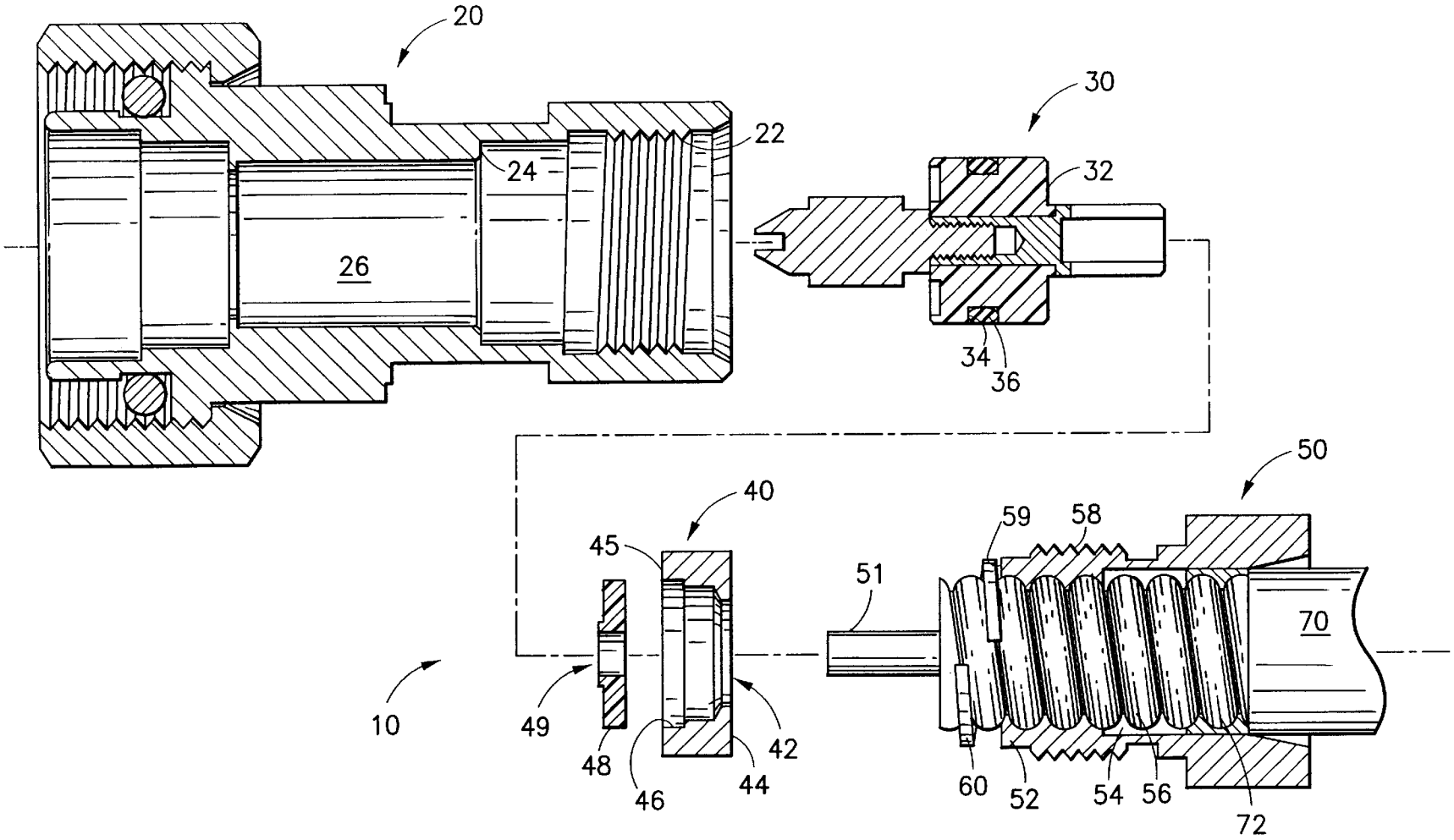
FIG. 1, which illustrates an exploded cross-sectional view of the connector assembly, the cable and split washer of the assembly are not shown in cross-section.

The present invention is a connector which may be used for connecting coaxial cables to other cables or electrical devices such as antennas. Referring to FIG. 1, the connector 10 of the present invention includes a substantially standard body member 20 made from a conductive material such as brass. The body member 20 includes an internal threaded portion 22, a shoulder portion 24 within its interior 26.

Figure 2:
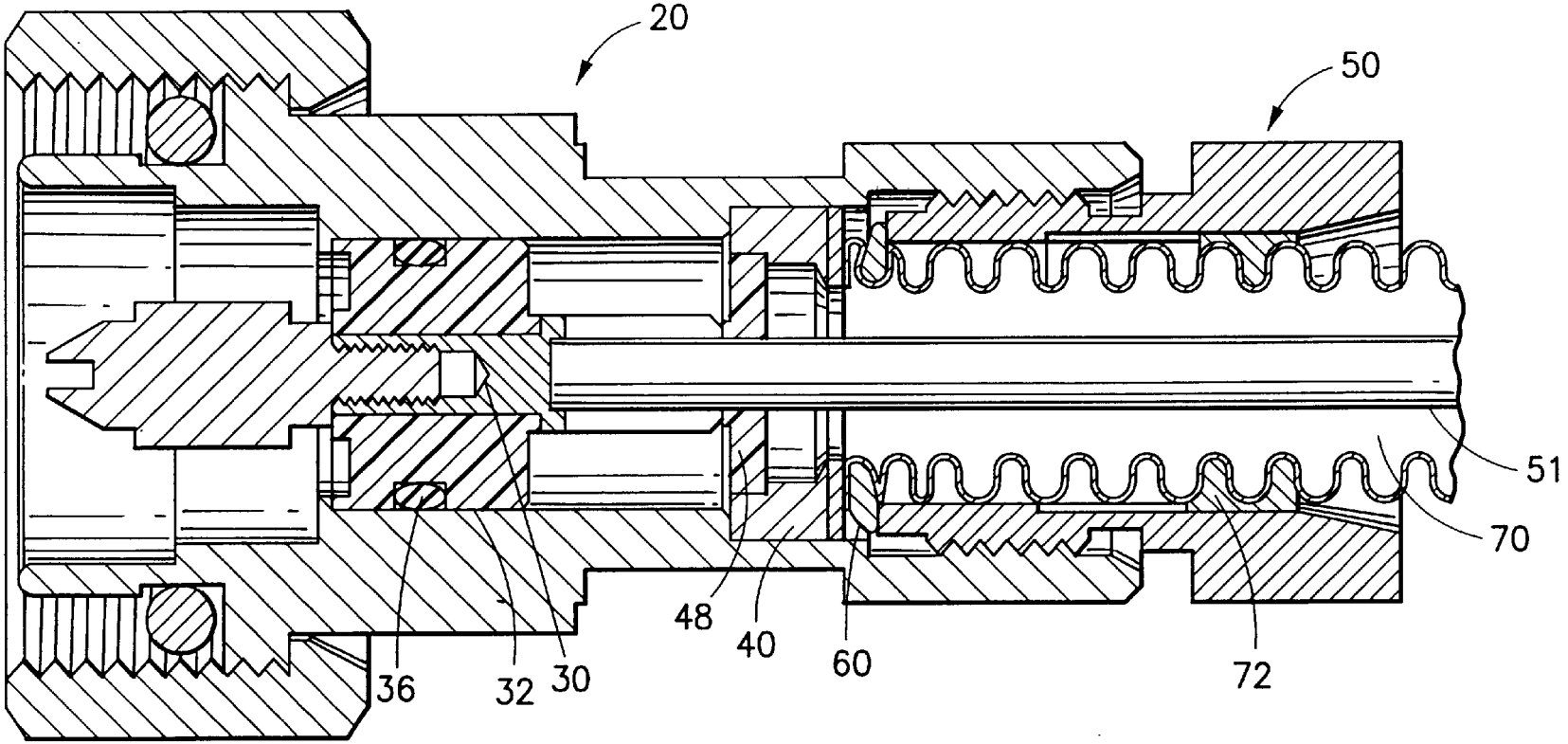
FIG. 2, which illustrates a cross-sectional view of the connector assembly after it is assembled.

The connector 10 further includes an ordinary inner conductor contact member 30 having a dielectric spacer 32 disposed thereover. As illustrated in FIG. 2, the inner conductor contact member 30 and dielectric spacer 32 reside in the interior 26 of the body member 20 when the connector 10 is assembled. The dielectric spacer 32 is dimensioned so as to provide a snug fit within the interior 26 of the body 20. The dielectric spacer 32 may be provided with a groove 34 and an O-ring 36 may be fitted within the groove to provide an internal moisture barrier between the body 20 and the dielectric spacer 32 within the connector 10.

The connector 10 further includes a VSWR compensating clamping insert member 40 which is cup shaped in cross-section. The insert has a body abutting end 45 and a base 44 with opening 42. The opening 42 is preferably made smaller than the inside diameter of the outer conductor 56 of the cable. The clamping insert member 40 is provided with an interior shoulder 46 for seating a dielectric insert 48 having an opening 49. The opening 49 has an inner diameter of dimensions close to the outside diameter of the inner conductor 51 of the cable.

The connector of the present invention also includes a backnut 50 which includes an interior threaded portion 52 having threads 54 corresponding to the helical corrugations of the outer conductor 56. The interior threaded portion 52 only aids in assembly and is not to aid in the clamping action. The backnut 50 further includes an exterior threaded portion 58 which cooperates with the internal threaded portion 22 of the body 20. The backnut also includes a bearing surface 59 at its internal terminal end, the end which resides within the body when the connector is assembled.

Figure 6:
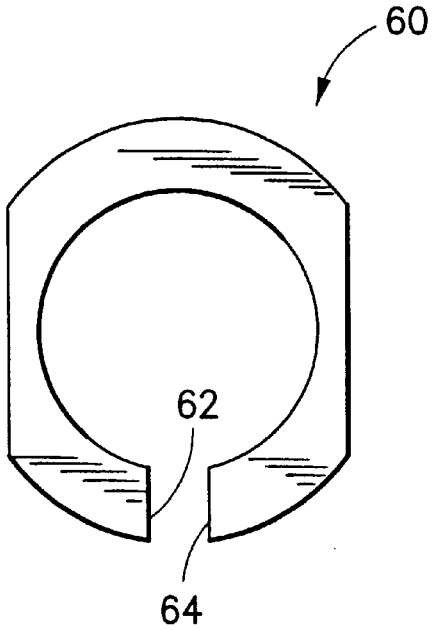
FIG. 6, which is a plan view of the split washer.

Referring to FIGS. 1 and 6, the connector of the present invention is further provided with a helical split washer 60, having facing ends 62, 64, which is fabricated to have dimensions such that it may be threaded onto the helical outer conductor 56 of the cable as shown in FIG. 1 prior to assembly. The helical split washer is preferably made from a deformable material such as brass or steel; however, plastic such as Delrin or nylon may be acceptable.

Figure 3:
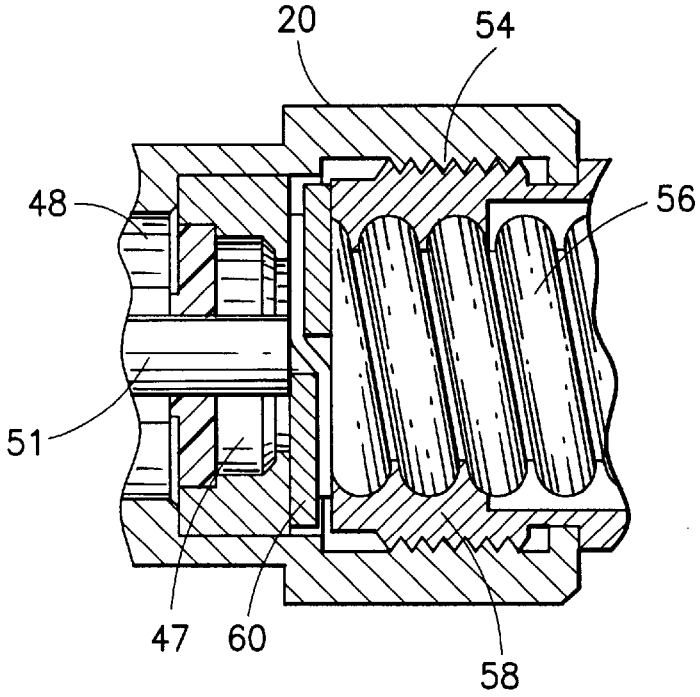
FIG. 3, which is a partial cross-sectional view of the assembly illustrating deformation of the split washer.
Figure 4:
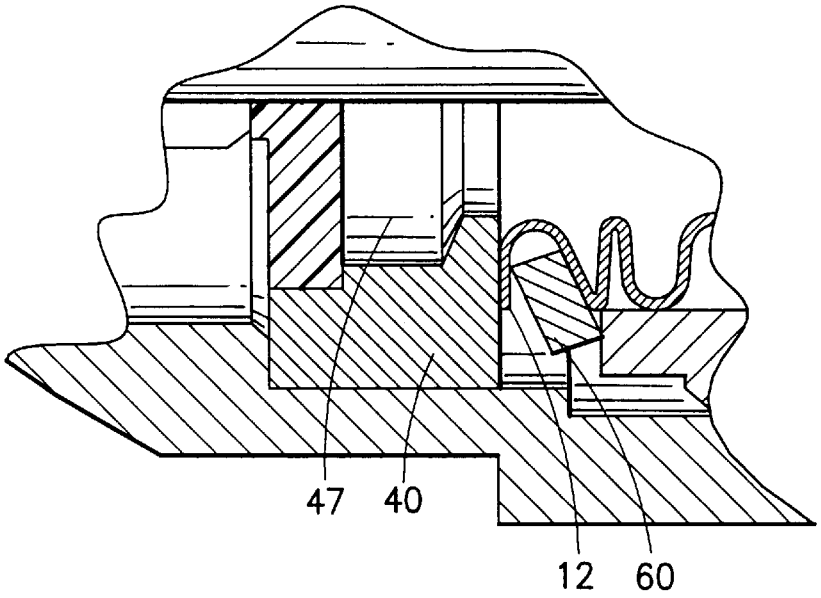
FIG. 4, which is a partial cross-sectional view of the assembly illustrating the interface between the split washer, outer conductor, clamping insert and backnut bearing surface.

The assembled connector shown in FIG. 2 is achieved by removing the outer sheath 70 to expose a sufficient length of the outer-conductor 56, installing a corrugated gasket 72 over the outer-conductor 56, threading or placing the backnut 50 onto the outer-conductor and corrugated gasket 72 such that a moisture-proof seal is formed between the corrugated gasket 72 and the backnut 50 and between the outer-conductor 56 and the corrugated gasket 72, and as shown in FIGS. 1 and 2. The back nut 50 is placed onto the outer conductor so as to allow a length of outer conductor to extend from the backnut's bearing surface 59 which is equal to approximately one to one-and-a-half times the length of a pitch of the corrugation. After the backnut is placed onto the outer conductor, the split washer 60 is threaded onto the outer-conductor 56 so that the split washer 60 is adjacent to bearing surface 59 of the backnut 50. After the helical split washer 60 is threaded onto the outer conductor, the clamping insert 40 is positioned within the body 20, having the inner-conductor 30 already positioned therein, so as to rest on the interior shoulder 24. The threads 22 of the body 20 are mated to the threads 58 of the backnut 50 and the body and backnut are rotated relative to each other so as to draw them together. The backnut cannot be rotated with respect to cable if it has internal threads. As the body 20 is threaded onto the backnut 50, the split washer 60 is clamped between bearing surface 59 of the backnut and a deformed portion of the outer conductor 56, which is contacted by the base 44 of the clamping insert 40. The deformation of the outer-conductor 56 caused by the split washer 60 prevents the split washer 60 from unthreading from the outer conductor 56. The deformation of the outer conductor 56 also creates a low impedance section. The low impedance section is compensated by the cavity 47 within the clamping insert shown in FIG. 3.

Figure 5A:
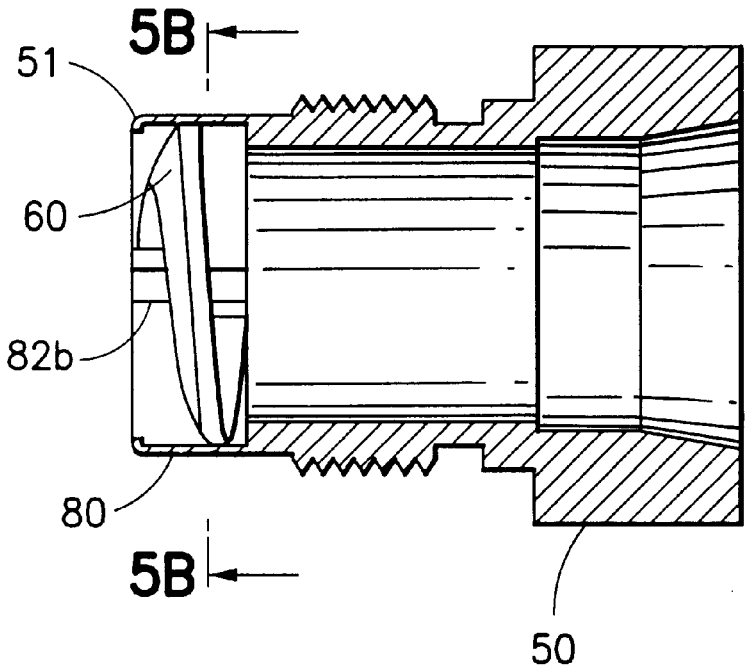
FIGS. 5A through 5C, which are cross-sectional views of an alternative embodiment of the present invention wherein the split washer is contained within a tubular extension of the backnut.
Figure 5B:
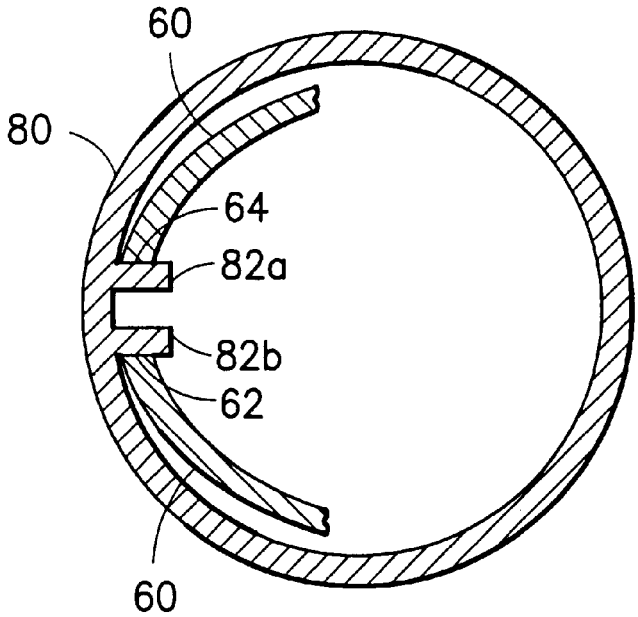
Figure 5C:
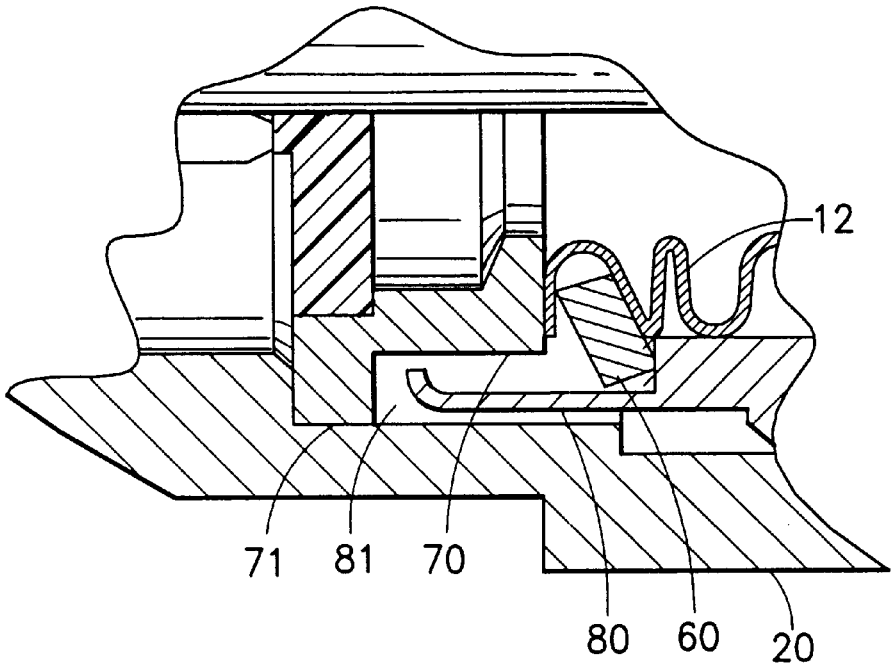

Another embodiment of the invention is depicted in FIGS. 5A through C. In this embodiment, the split washer 60 is contained within a tubular extension 80 which extends from a portion of the bearing surface 59 of the backnut 50. The tubular extension 80 has a rim 81. The rim 81 is shown as sloped radially inward toward its center. The backnut 50, tubular extension 80 and split washer 60 are installed on the outer conductor 56 by twisting the backnut 50 so that the split washer 60 engages the corrugations of the outer conductor 56. The backnut cannot have internal threads in this embodiment. The extension 80 has a pair of internal longitudinal ridges 82*a* and 82*b* (FIG. 5B). The split washer 60 resides in the extension so that its facing ends 62 and 64 straddle the longitudinal ridges 82*a* and 82*b* as illustrated in FIG. 5B. Longitudinal ridge 82*a* and 82*b* force the split washer 60 to rotate with the backnut 50 while rim 81 holds the split washer 60 in the tubular extension 80. The split washer 60 can be threaded onto the outer conductor by simply rotating the backnut 50. It is apparent from the foregoing discussion that the slope of rim 81 may be replaced by a functionally equivalent radial indentation (not shown) in the tubular extension 80 which will prevent the split washer 60 from leaving the confines of the tubular extension 80.

If the tubular extension 80 is incorporated into the backnut 50, the cup-shaped clamping insert 40 must be designed to accommodate the tubular extension 80. FIG. 5C shows a clamping insert 40 having a reduced outside diameter 70 and an outwardly extending flange which rests on the interior shoulder 22 of the body 20. When the connector is assembled, the tubular extension 80 resides between the interior of the body 20, the outwardly extending flange 71 and the exterior of the clamping insert 40.

As can be seen from the foregoing detailed description of the preferred embodiments of the invention, the connector assembly 10 provides a means of electromagnetically connecting the helically corrugated outer conductor 56 and the inner conductor 11 of a coaxial cable 10 to a standard shaped connection 30. In addition, the connector assembly 40 minimizes the number of parts required to connect a coaxial cable 10; fewer parts reduces assembly time and reduces the chance that essential parts will be lost.

Although the present invention has been described with respect to one or more particular embodiments of the apparatus, it will be understood that other embodiments of the present invention may be made without departing from the spirit and scope of the present invention. Hence, the present invention is deemed limited only by the appended claims and the reasonable interpretation thereof.

What is claimed is:

1. A connector for connecting a coaxial cable having an inner-conductor and a helically corrugated outer-conductor comprising:

a cylindrical body having an interior, an internal threaded portion for engagement with a threaded backnut, and a shoulder portion for supporting a VSWR compensating clamping insert, the shoulder portion being disposed within its interior;

an inner conductor contact having a dielectric spacer disposed thereover, the inner conductor contact being disposed within the interior of the cylindrical body and the dielectric spacer being dimensioned so as to provide a snug fit within the interior of the cylindrical body;

a VSWR compensating cup shaped clamping insert, the clamping insert further having a body abutting end, a base with an opening which is dimensioned to allow the inner conductor to pass therethrough and an interior shoulder at the body abutting end for supporting a dielectric insert, and wherein the clamping insert member is disposed within the cylindrical body so that the body abutting end is adjacent to the shoulder portion of the body;

a dielectric insert having an opening with a diameter which is sufficient to allow an inner conductor to pass therethrough, wherein the dielectric insert is disposed within the clamping insert adjacent to its shoulder portion;

a backnut having a terminal end which resides within the body, an interior threaded portion with threads corresponding to the helical corrugations of the outer conductor, an exterior threaded portion for cooperating with the internal threaded portion of the body, a bearing surface at its internal terminal end; and a deformable helical split washer having a pair of facing ends;

whereby, the outer conductor is deformed and clamped between the split washer and the base of the clamping insert, and whereby the split washer is deformed when the connector is assembled by threading the interior threads of the body with the exterior threads of the backnut.

2. The connector of claim 1, wherein the backnut further comprises a tubular extension extending coaxially from its bearing surface having dimensions suitable for captivating the split washer therein.

3. The connector of claim 2, wherein the tubular extension further includes an inwardly facing rim for further captivating the split washer.

4. The connector of claim 3, wherein the tubular extension further includes a pair of longitudinal ridges within its interior for engaging the facing ends of the split washer.

5. The connector of claim 2, wherein the outside diameter of the clamping insert is dimensioned so as to permit the tubular extension to reside between the clamping insert and the body when the connector is assembled.

6. The connector of claim 5, wherein the body abutting end of the clamping insert is provided with a outwardly extending flange.

7. A connector for connecting a coaxial cable having an inner-conductor and a helically corrugated outer-conductor comprising:

a cylindrical body having an interior, an internal threaded portion for engagement with a threaded backnut, and a shoulder portion for supporting a VSWR compensating clamping insert, the shoulder portion being disposed within its interior;

an inner conductor contact having a dielectric spacer disposed thereover, the inner conductor contact being disposed within the interior of the cylindrical body and the dielectric spacer being dimensioned so as to provide a snug fit within the interior of the cylindrical body;

a VSWR compensating cup shaped clamping insert, the clamping insert further having a body abutting end, a base with an opening which is dimensioned to allow the inner conductor to pass therethrough and an interior shoulder at the body abutting end for supporting a dielectric insert, and wherein the clamping insert member is disposed within the cylindrical body so that the body abutting end is adjacent to the shoulder portion of the body;

a dielectric insert having an opening with a diameter which is sufficient to allow an inner conductor to pass therethrough, wherein the dielectric insert is disposed within the clamping insert adjacent to its shoulder portion;

a backnut having a terminal end which resides within the body, an exterior threaded portion for cooperating with the internal threaded portion of the body, a bearing surface at its internal terminal end, and a tubular extension extending coaxially from its bearing surface;

a deformable helical split washer having a pair of facing ends, the split washer being disposed within the tubular extension of the backnut;

whereby, the outer conductor is deformed and clamped between the split washer and the base of the clamping insert, and whereby the split washer is deformed when the connector is assembled by threading the interior threads of the body with the exterior threads of the backnut.

8. The connector of claim 7, wherein the tubular extension further includes an inwardly facing rim for further captivating the split washer.

9. The connector of claim 8, wherein the tubular extension further includes a pair of longitudinal ridges within its interior for engaging the facing ends of the split washer.

10. The connector of claim 7, wherein the outside diameter of the clamping insert is dimensioned so as to permit the tubular extension to reside between the clamping insert and the body when the connector is assembled.

11. The connector of claim 10, wherein the body abutting end of the clamping insert is provided with a outwardly extending flange.

* * * * *